US006185741B1

(12) United States Patent
Kehoe

(10) Patent No.: US 6,185,741 B1
(45) Date of Patent: Feb. 13, 2001

(54) CONVERTIBLE LADIES SWIMSUIT

(76) Inventor: Anastasia Kehoe, 1045 Fifth Ave., Apt. 3B, New York, NY (US) 10028

( * ) Notice: Under 35 U.S.C. 154(b), the term of this patent shall be extended for 0 days.

(21) Appl. No.: 09/595,686

(22) Filed: Jun. 16, 2000

Related U.S. Application Data

(63) Continuation-in-part of application No. 09/436,377, filed on Nov. 9, 1999.

(51) Int. Cl.[7] ..... A41D 5/00
(52) U.S. Cl. ..... 2/67; 2/69
(58) Field of Search ..... 2/67, 69, 1, 228, 2/238, 78.1, 78.2, 406, 408; 441/102–107, 120, 122; 450/1, 3, 5, 6

(56) References Cited

U.S. PATENT DOCUMENTS 4,656,669 * 4/1987 Beard ..... 2/67
4,815,145 * 3/1989 Chow ..... 2/67

* cited by examiner

*Primary Examiner*—Gloria M. Hale
(74) *Attorney, Agent, or Firm*—Davidson, Davidson & Kappel, LLC; Morey B. Wildes, Esq.

(57) ABSTRACT

A convertible swimsuit is a one-piece bathing suit that can be changed to a two-piece tank top style or bikini style bathing suit for purposes such as, but not limited to, tanning or using the restroom. This is accomplished by unfastening the upper piece of the swimsuit from the lower piece of the swimsuit. The material at the bottom of the upper piece of the swimsuit is folded upward and fastened behind the back to create a two piece tank-top style bathing suit. The material can again be folded further upward and fastened either behind the back or behind the neck to create a bikini-style bathing suit. The wearer can thereby use the swimsuit as either a one-piece swimsuit or as a two-piece swimsuit with adjustable coverage of the individual's stomach or midriff.

31 Claims, 4 Drawing Sheets

CONVERTIBLE LADIES SWIMSUIT

CROSS REFERENCE TO RELATED APPLICATION

This application is a continuation-in-part application of U.S. patent application No. 09/436,377, filed Nov. 9, 1999.

BACKGROUND OF THE INVENTION

This invention pertains to women's apparel and, in particular, swimwear. More particularly, this invention relates to a woman's swimsuit that can be converted from one-piece to two-piece and back again.

Traditionally, it has been a challenge to design women's swimsuits that are comfortable, stylish and functional. Swimsuits, particularly two-piece swimsuits known as bikinis, allow women to have more of their bodies exposed to the sun for tanning purposes. However, two-piece swimsuits may not be practical for active sports, such as vigorous swimming, diving and water skiing, where the forces of impact and water may partially disrobe the wearer. Moreover, two-piece swimsuits also offer little coverage of the wearer's body imperfections, such as scars or the like. One-piece women's swimsuits, on the other hand, which allow the wearer to engage in more strenuous water sports and may offer more surface coverage of the wearer's bodily imperfections, tend to be less comfortable and do not allow the wearer to attain as compete a suntan. In addition, a one-piece swimsuit may be less functional to the wearer, such as by requiring the wearer to completely disrobe in order for the wearer to use the bathroom.

In the past, there have been various attempts to design swimsuits that are able to combine fashion, comfort and function in a multipurpose swimsuit design for allowing a wearer to switch between a one- and two-piece swimsuit design. For example, U.S. Pat. No. 4,815,145 (Chow), entitled Convertible Bathing Suit, discloses a two-piece swimsuit that is equipped with a separate midriff fabric portion. The midriff fabric portion is removably attached to the front of the swimsuit between the bottom edge of the swimsuit top and the top edge of the bikini bottom so as to convert the two-piece bikini swimsuit into a one-piece swimsuit. In this manner, using a separate piece of fabric, the wearer can selectively convert between a two-piece swimsuit and one that appears, at least from the front, to be one-piece. However, this extra fabric portion must be inconveniently retained and carried by the wearer, so that switching from a two-piece swimsuit design to a one-piece swimsuit design can be accomplished without delay.

U.S. Pat. No. 4,656,669 (Beard), entitled Versatile Bathing Suit, discloses a two-piece ladies' swimsuit that has a hidden pocket or pouch within the swimsuit's bottom piece for containing additional materials for complementing the swimsuit. As disclosed, one such material that the pouch can contain is a piece of fabric or material for covering the wearer's abdomen, which piece may be attached with fasteners between the bottom edge of the swimsuit's top piece and the top edge of the swimsuit's bottom piece, either completely or partially around the wearer's body, in order to convert a two-piece swimsuit into a one-piece swimsuit. Similar to the Chow patent described above, this patent allows the wearer to convert the two-piece swimsuit into a one-piece swimsuit using a separate piece of fabric. Again, unfortunately, this extra separate fabric portion must be inconveniently retained and carried by the wearer, in case switching from a one-piece swimsuit design to a two-piece swimsuit design is desired.

U.S. Pat. No. 4,301,545 (Camarena), entitled Adjustable Swimsuit, discloses a two-piece swimsuit whose bottom piece has an intermediate connector flap that extends upward from the top edge of the bottom piece and is integral with the bottom piece. When the wearer desires to wear a one-piece swims suit, the connector flap can be pulled upward and attached to the bottom edge of the swimsuit's top piece using one or more connector elements. This flap can be tucked into the swimsuit bottom piece when the wearer desires to wear a two-piece swimsuit. In this manner, too, the wearer can convert the two-piece swimsuit into one that appears, at least from the front, to be one-piece. However, because the bottom piece of the swimsuit fits smoothly against the wearer's skin, when the wearer is wearing a two-piece swimsuit, the connector flap is uncomfortably and noticeably tucked into the bottom piece of the swimsuit.

U.S. Pat. No. 5,717,998 (Everett et al.), entitled Swimsuit with Displaceable Crotch, discloses a one-piece ladies'swimsuit in which the bottom portion is displaceable such that it can be separated from the front of the swimsuit (or the back, in another embodiment) and swung down, between the wearer's legs and away from the wearer's crotch. This swimsuit functionally offers a solution to the problem that women experience while attempting to remove a swimsuit in order to use the toilet, by allowing the crotch piece to be swung down, without the entire swimsuit having to be removed. Although the swimsuit disclosed in Everett et al. is functional and allows the wearer to use the bathroom without completely disrobing, it does not allow the wearer to covert easily between one- and two-piece swimsuits. In another embodiment shown in this patent, the top and bottom pieces of the two-piece swimsuit are separate and the elastic bands at their adjacent respective bottom and top edges are covered by a separate skirt or sash. Here, too, no mechanism is provided to allow the wearer to covert easily between one- and two-piece swimsuits.

Accordingly, it is one object of the present invention to provide a women's swimsuit that will allow a wearer to selectively switch between wearing a one-piece swimsuit and a two-piece swimsuit.

It is another object of the present invention to provide a women's swimsuit that will allow the wearer to adjust the swimsuit in order to provide the desired degree of exposure and concealment depending on the particular circumstances in which the wearer is found.

SUMMARY OF THE INVENTION

These and other objects of the invention are accomplished by providing a convertible ladies' swimsuit that can be changed from a one-piece swimsuit into either a two-piece tank-top style swimsuit or two-piece bikini style swimsuit for purposes such as, but not limited to, tanning or using the restroom. The swimsuit has a top piece and a separate bottom piece that may be attached to each other along the top edge of the bottom piece and the bottom edge of the top piece, using any of a number of attachment or fastening means such as snaps, Velcro (hook and loop elements) or any other appropriate fastening means, to form a one-piece swimsuit. The top piece can be unfastened from the bottom piece to allow the wearer to conveniently use the bathroom. The lower region of the top piece can also be unfastened from the bottom piece, folded upward, either under or over the lower region of the top piece, and fastened behind the wearer's back to create a tank-top style or a bikini-type two-piece swimsuit. The lower region of the top piece can alternatively be folded up completely over the front of the swimsuit and secured behind the wearer's neck to create a bikini style swimsuit, which allows for complete sunning of the midriff.

BRIEF DESCRIPTION OF THE DRAWINGS

The above and other objects and advantages of the invention will be apparent upon consideration of the following detailed description, taken in conjunction with the accompanying drawings, in which the reference characters refer to like parts throughout and in which.

DETAILED DESCRIPTION OF THE INVENTION

Figure 1:
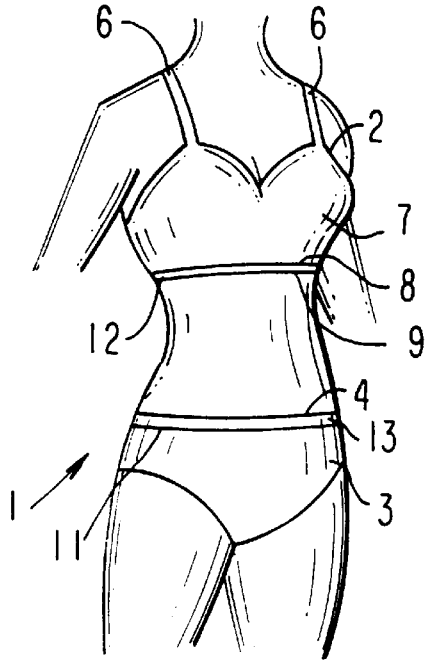
FIG. 1 shows a front view of the swimsuit of the present invention in its state as a one-piece swimsuit.
Figure 2:
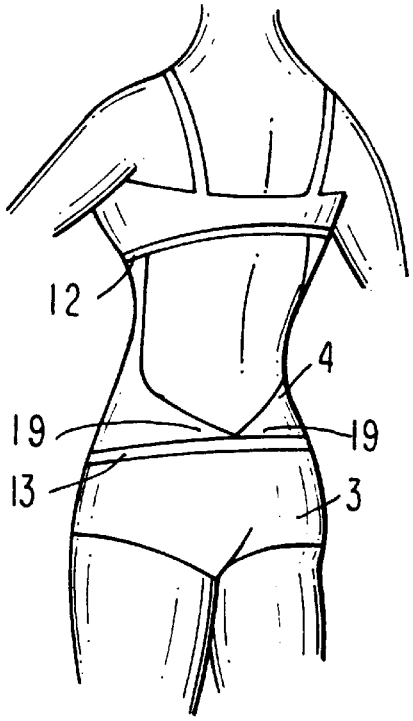
FIG. 2 shows a back view of the swimsuit of the present invention in its state as a one-piece swimsuit.

Referring now to FIGS. 1 and 2, the ladies' swimsuit 1 of the present invention has a top section 2 and a bottom section 3, between which is a midsection 4. FIG. 1 shows a front view of swimsuit 1, and FIG. 2 shows a back view of swimsuit 1, in use on a wearer. Top section 2 has two shoulder straps 6 that suspend a bustline portion 7 from the wearer's shoulders. The bustline portion 7 of top section 2 is integrally connected with midsection 4 of swimsuit 1. Bottom section 3 of swimsuit 1 is preferably separately formed from both top section 2 and midsection 4 of swimsuit 1 but is attached to midsection 4 along the upper edge 11 of bottom section 3 and the lower edge 10 of midsection 4, as will be discussed below.

Figure 4:
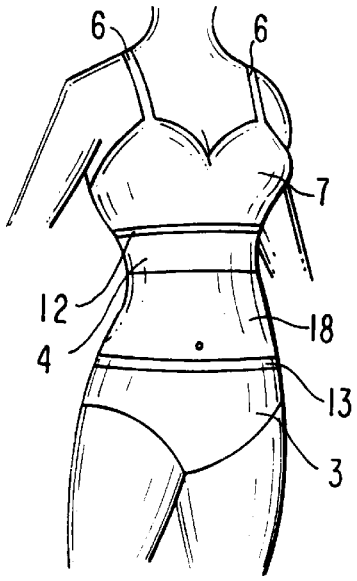
FIG. 4 shows a front view of the swimsuit of the present invention in its state as a two-piece swimsuit.
Figure 5:
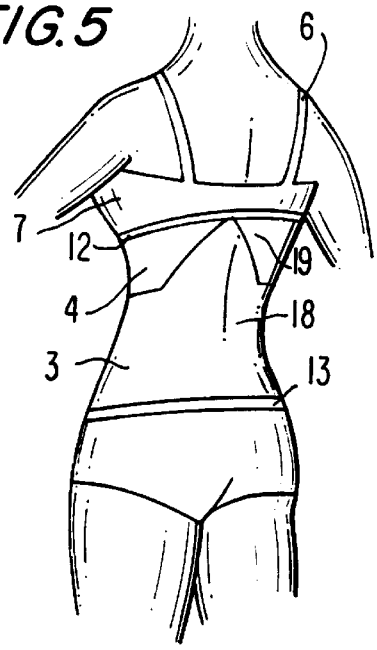
FIG. 5 shows a back view of the swimsuit of the present invention in its state as a two-piece swimsuit.

Swimsuit 1 can be worn as a one-piece swimsuit, as shown in FIGS. 1 and 2, or as a two-piece swimsuit, as shown in FIGS. 4 and 5. Swimsuit 1 can easily be converted from a one-piece swimsuit to a two-piece swimsuit and visa versa using fasteners. A number of securing elements or fasteners are located along the body of swimsuit 1 for attaching portions of swimsuit 1 to other portions of swimsuit 1. Fasteners can be any one of a number of different types of mating means for attaching one material to another, such as snaps, buttons and button holes, hooks and eyes, resilient hook and loop elements (commonly known as Velcro®) and the like. Typically, each of these fasteners will have two elements that attach one to the other, either in a male/female relationship or in some other cooperating relationship that allows one portion of each fastener to be utilized only in conjunction with the other portion of that fastener. Although the figures of this patent typically show fasteners as snaps, it will be understood that any of the fasteners mentioned, or any fasteners similar thereto, may be used without deviating from the principles of the invention.

Figure 3:
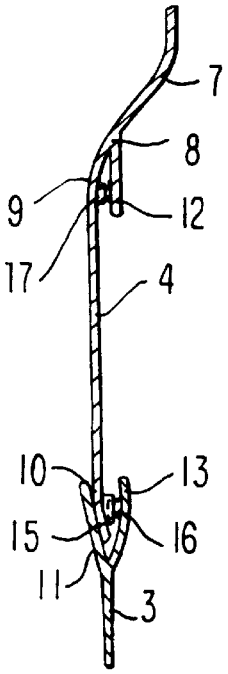
FIG. 3 shows a cross-sectional view of the front of the swimsuit shown in FIG. 1.

FIGS. 1 and 2 show swimsuit 1 being worn by a wearer as a one-piece swimsuit, and a cross-sectional view of the fabric of the front of swimsuit 1 in its one-piece form is shown in FIG. 3 (the wearer is to the left of the fabric shown). As shown in cross-section in FIG. 3, swimsuit 1 has a flap 12 that extends downward from the lower edge 8 of bust line portion 7 and over the upper edge 9 of midsection 4. Flap 12 extends completely around swimsuit 1, as illustrated in FIGS. 1 and 2. Upper edge 11 of bottom section 3 of swimsuit 1 has a flap 13 that extends upward towards and over upper edge 11 of bottom section 3. Flap 13 extends completely around swimsuit 1, as illustrated in FIGS. 1 and 2. Because functional fasteners are typically not considered to be esthetically pleasing, flap 12 is used to hide such fasteners from view between flap 12 and upper edge 9 of midsection 3 of swimsuit 1, and flap 13 is used to hide such fasteners from view between flap 13 and upper edge 11 of bottom section 3 of swimsuit 1, as will be discussed below.

Figure 6:
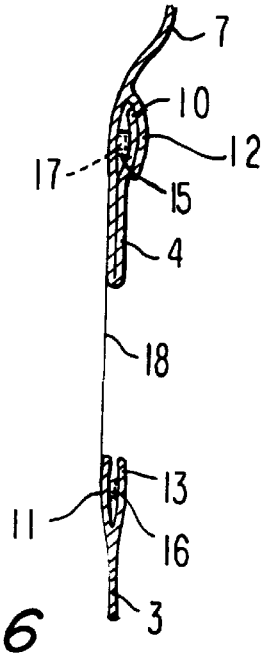
FIG. 6 shows a cross-sectional view of the front of the swimsuit shown in FIG. 4.

For the purposes of this invention, flap 13 along upper edge 11 of bottom section 3 of swimsuit 1 may be disposed either along the outside of upper edge 11 of bottom section 3 or along the inside thereof. The cross-sectional views of FIGS. 3 and 6 show flap 13 disposed along the outside of upper edge 11 of bottom section 3 for consistency in this description. It It should be realized that flap 13 could be disposed along the inside of upper edge 11 of bottom section 3, and all respective references to flap 13 and upper edge 11 of bottom section 3 could be reversed.

On swimsuit 1 of the current invention, one set of cooperating fasteners 15,16 is located along lower edge 10 of midsection 4 and along upper edge 11 of bottom section 3. Along lower edge 10 of midsection 4, a number of fasteners 15 are located. Along upper edge 11 of bottom section 3, between flap 13 and upper edge 11, a number of fasteners 16 are located to mate with fasteners 15 along lower edge 10 of midsection 4. Fasteners 15,16 cooperate by attaching lower edge 10 of midsection 4 to upper edge 11 of bottom section 3 when the wearer desires to wear swimsuit 1 as a one-piece swimsuit. When the wearer desires to wear swimsuit 1 as a one-piece swimsuit, fasteners 15 at lower edge 10 of midsection 4 are mated with fasteners 16 at upper edge 11 of bottom section 3 so as to attach midsection 4 to bottom section 3. Then, when the wearer desires to use the bathroom, fasteners 16 at upper edge 11 of bottom section 3 can be unfastened from fasteners 16 at upper edge 11 of bottom section 3 so that the wearer can remove bottom section 3 of swimsuit 1 to allow the wearer to conveniently use the bathroom without having to remove the entire swimsuit 1.

In one embodiment, as shown in FIG. 3, fasteners 15 at lower edge 10 of midsection 4 are affixed to midsection 4 such that they face outward, and fasteners 16 along upper edge 11 of bottom section 3 that mate with fasteners 15 are affixed to upper edge 11 of bottom section 3 such that they face inward, i.e., they are affixed to the inside surface of flap 13 do facing upper edge 11 of bottom section 3. When the user desires to mate fasteners 15,16 for the purpose of converting swimsuit 1 into a one-piece swimsuit by attaching lower edge 10 of midsection 4 to upper edge 11 of bottom section 3, lower edge 10 of midsection 4 is placed between upper edge 11 of bottom section 3 and flap 13 such that fasteners 15 are opposite to fasteners 16, and fasteners 15 are mated with fasteners 16.

Alternatively, in another embodiment (not shown), fasteners 15 at lower edge 10 of midsection 4 are affixed to midsection 4 such that they face inward, and fasteners 16 along upper edge 11 of bottom section 3 that mate with fasteners 15 are affixed to bottom section 3 such that they face outward, i.e., they are affixed to the outside surface of bottom section 3 such that they face flap 13. When the user desires to mate fasteners 15,16 for the purpose of converting swimsuit 1 into a one-piece swimsuit by attaching lower edge 10 of midsection 4 to upper edge 11 of bottom section 3, lower edge 10 of midsection 4 is placed between upper edge 11 of bottom section 3 and flap 13 such that fasteners 15 are opposite to fasteners 16, and fasteners 15 are mated with fasteners 16.

In the above-described embodiments, fasteners 15 could be male and fasteners 16 could be female, or visa versa. However, in order for lower edge 10 of midsection 4 and upper edge 11 of bottom section 3 to be attached (for fasteners 15,16 to mate with each other), fasteners 15,16 cannot both be male or both be female.

FIGS. 4 and 5 show swimsuit 1 being worn by a wearer as a two-piece swimsuit, and a cross-sectional view of the fabric of the front of swimsuit 1 in its two-piece form is shown in FIG. 6. As shown best in FIG. 3, another group of fasteners 17 are located along upper edge 9 of midsection 4, between flap 12 and upper edge 9 of midsection 4. Fasteners 17 are adapted to mate with fasteners 15 that are situated along lower edge 10 of midsection 4. When swimsuit 1 is worn as a one-piece swimsuit, as illustrated in FIGS. 1–3, fasteners 17 are covered by flap 12 and are hidden from view. However, when the wearer desires to wear swimsuit 1 as a two-piece swimsuit, as illustrated in FIG. 6, fasteners 15,17 cooperate by attaching lower edge 10 of midsection 4 to upper edge 9 of midsection 4.

When the wearer desires to wear swimsuit 1 as a two-piece swimsuit, fasteners 15 are first detached from fasteners 16. Then, as shown in FIGS. 4–6, midsection 4 is folded upward, either under itself or over itself, and fasteners 15 at lower edge 10 of midsection 4 are mated with fasteners 17 at upper edge 9 of midsection 4 so as to attach lower edge 10 of midsection 4 to upper edge 9 of midsection 4, thereby revealing the wearer's midriff 18 and converting swimsuit 1 from a one-piece swimsuit into a two-piece tank-top style swimsuit. Fasteners 16, which are not used when swimsuit 1 is worn as a two-piece swimsuit, are covered by flap 13 and are hidden from view. Fasteners 16 are covered by flap 13 also in order to avoid discomfort to the wearer.

In the first embodiment of fastener orientation discussed above, as shown in FIG. 3, fasteners 15 at lower edge 10 of midsection 4 are affixed to midsection 4 such that they face outward. Accordingly, in this first embodiment, fasteners 17 along upper edge 9 of midsection 4 that mate with fasteners 15 are affixed to midsection 4 such that they also face outward, i.e., they are affixed to the outside surface of upper edge 9 of midsection 4 such that they face flap 12. Then, when the user desires to mate fasteners 15,17 for the purpose of converting swimsuit 1 into a two-piece swimsuit by attaching lower edge 10 of midsection 4 to upper edge 9 of midsection 4, as illustrated in FIG. 6, lower edge 10 of midsection 4 is folded upward and placed between upper edge 9 of midsection 4 and flap 12 such that fasteners 15 are opposite to fasteners 17, and fasteners 15 are mated with fasteners 17.

In the alternative embodiment of fastener orientation discussed above (not shown), fasteners 15 at lower edge 10 of midsection 4 are affixed to midsection 4 such that they face inward, and fasteners 17 along upper edge 9 of midsection 4 that mate with fasteners 15 are affixed to upper edge 9 of midsection 4 such that they also face inward, i.e., they are affixed to the inside surface of flap 12 facing upper edge 9 of midsection 4. When the user desires to mate fasteners 15,17 for the purpose of converting swimsuit 1 into a two-piece swimsuit by attaching lower edge 10 of midsection 4 to upper edge 9 of midsection 4, lower edge 10 of midsection 4 is folded upward and placed between upper edge 9 of midsection 4 and flap 12, such that fasteners 15 are opposite to fasteners 17 and are mated with fasteners 17.

In the above-described embodiments, fasteners 15 could be male and fasteners 17 could be female, or visa versa. However, in order for lower edge 10 of midsection 4 and upper edge 9 of midsection 4 to be attached, fasteners 15,17 cannot both be male or both be female. In addition, it should be noted that fasteners 16 and fasteners 17, which both mate with fasteners 15, should either both be male or both be female.

Figure 7:
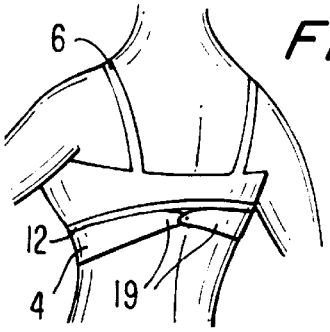
FIG. 7 shows a back view of an alternative way of converting the swimsuit of the present invention from its one-piece mode to its two-piece mode.

As shown in the rear views of FIGS. 2 and 5, midsection 4 is folded upwards either m under or over itself such that fasteners 15 at the lower edge 10 of midsection 4 are mated with fasteners 17 under flap 12. The rearmost ends 19 of lower edge 10 of midsection 4 are attached to upper edge 11 of bottom section 3, just as lower edge 10 of midsection 4 is at the front of swimsuit 1. This embodiment allows the wearer's midriff 18 to be shown. FIG. 7 shows the back view of an alternative way of converting swimsuit 1 from its one-piece mode to its two-piece tank-top style mode. In this embodiment, rearmost ends 19 of lower edge 10 of midsection 4 are not attached to upper edge 11 of bottom section 3 but rather are attached to each other in order to afford the wearer with a tighter fit. In this case, fasteners 15 at the rearmost ends 19 of lower edge 10 of midsection 4 are arranged so that they can mate to each of fasteners 16 (when swimsuit 1 is in its one-piece mode), fasteners 17 (when swimsuit 1 is in its two-piece mode) and fasteners 15 on each other. Thus, fastener 15 at one rearmost end 19 of lower edge 10 of midsection 4 will be male and fastener 15 at the other rearmost end 19 of lower edge 10 of midsection 4 will be female, with the corresponding fasteners 16 and 17 adapted to mate therewith for attachment.

Figure 8:
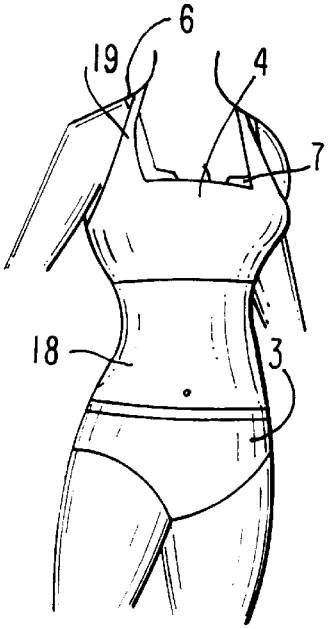
FIG. 8 shows a front view of another way of converting the swimsuit of the present invention from its one-piece mode to its two-piece mode.
Figure 9:
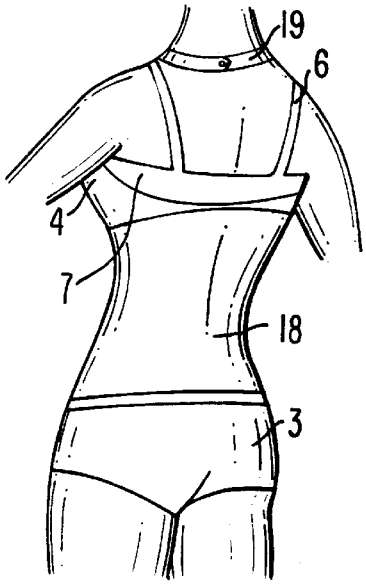
FIG. 9 shows a back view of another way of converting the swimsuit of the present invention from its one-piece mode to its two-piece mode.

FIGS. 8 and 9 show an alternative embodiment of the swimsuit of this invention having another way of converting the swimsuit of the present invention from its one-piece mode but now into a two-piece bikini-style mode. In the embodiment of FIGS. 8 and 9, the method of attachment of lower edge 10 of midsection 4 to upper edge 11 of bottom section of swimsuit 1 when swimsuit 1 is its one-piece mode is similar to that discussed above. However, when the wearer desires to convert swimsuit 1 from its one-piece mode to its two-piece mode, lower edge 10 of midsection 4 is detached from upper edge 11 of bottom section 3 is folded upwards over top section 2 such that midsection 4 extends almost completely over bust line portion 7 of top section 2 and such that rearmost ends 19 are folded completely over top section 2 of swimsuit 1 and are attached behind the wearer's neck. In this case, fasteners 15 at lower edge 10 of midsection 4 do not mate with fasteners 9 at upper edge 9 of midsection 4. Instead, only fasteners 15 at the rearmost ends 19 of lower edge 10 of midsection 4 mate, and then only with each other. Thus, fastener 15 at one rearmost end 19 of lower edge 10 of midsection 4 will be male and fastener 15 at the other rearmost end 19 of lower edge 10 of midsection 4 will be female, in order to mate with each other. This embodiment allows a greater amount of the wearer's midriff 18 to be shown than in the previous embodiments.

Figure 10:
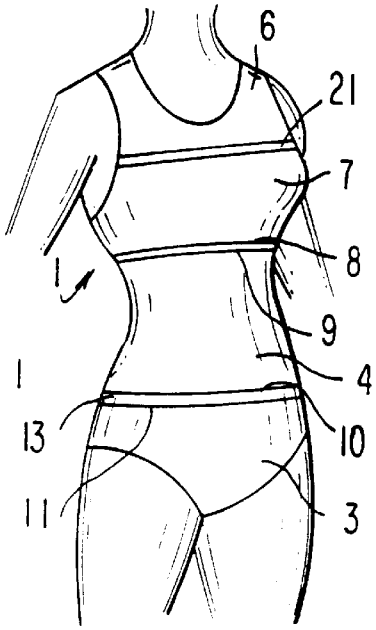
FIG. 10 shows a front view of an alternate embodiment of the present invention in its state as a one-piece swimsuit.
Figure 11:
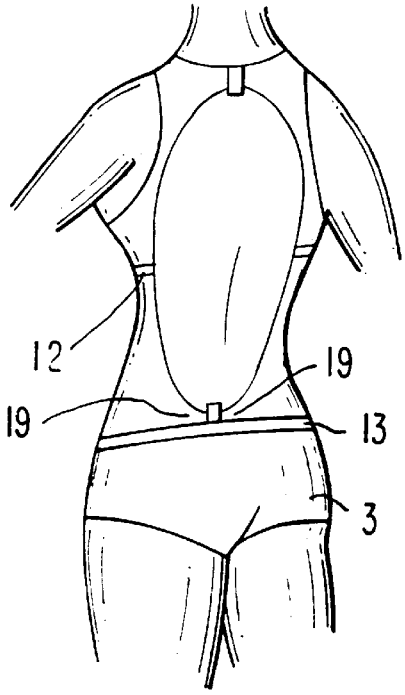
FIG. 11 shows a back view of the swimsuit shown in FIG. 10 in its state as a one-piece swimsuit.
Figure 12:
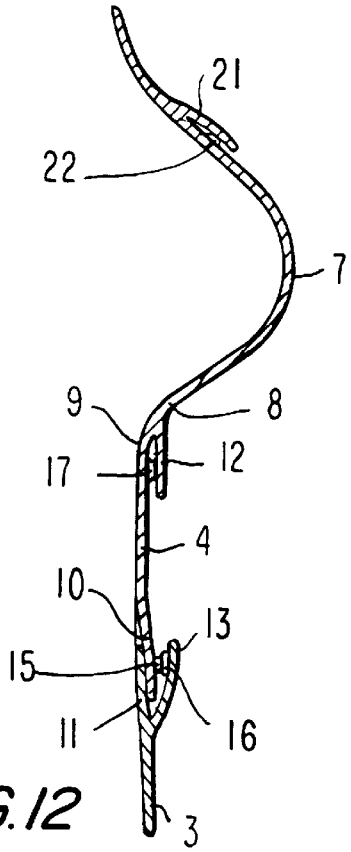
FIG. 12 shows a cross-sectional view of the front of the swimsuit shown in FIG. 10.

FIGS. 10–15 show a further alternative embodiment of the swimsuit of this invention having another way of converting the swimsuit of the present invention from its one-piece mode into a two-piece bikini-style mode. FIG. 10 shows swimsuit 1 being worn by a wearer as a one-piece swimsuit, and FIG. 12 shows a cross-sectional view of the fabric of the front of swimsuit 1 in its one-piece form (the wearer is to the left of the fabric shown). As shown in FIGS. 1–3, swimsuit 1 has the same components as previously described except that it also has a flap 21 that extends downward from above bust line portion 7. Flap 12 extends across the front of swimsuit 1, as illustrated in FIGS. 10 and 11, above bust line portion 7.

Figure 15:
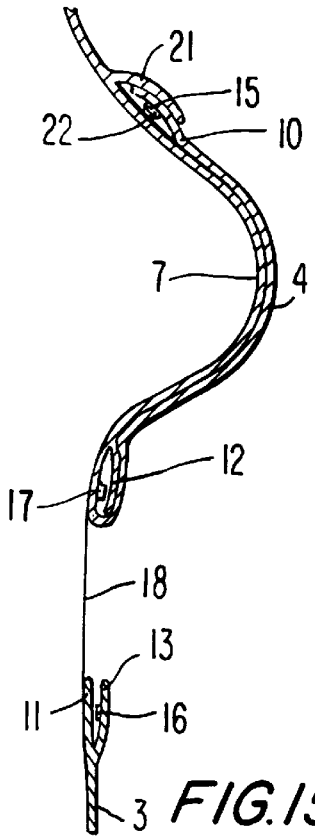
FIG. 15 shows a cross-sectional view of the front of the swimsuit shown in FIG. 10 in its state as a bikini-style swimsuit.
Figure 13:
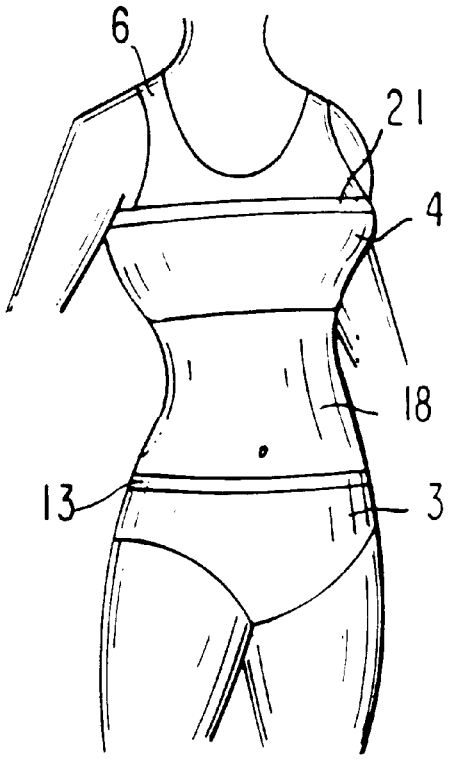
FIG. 13 shows a front view of the swimsuit of the present invention in its state as a bikini-style swimsuit.
Figure 14:
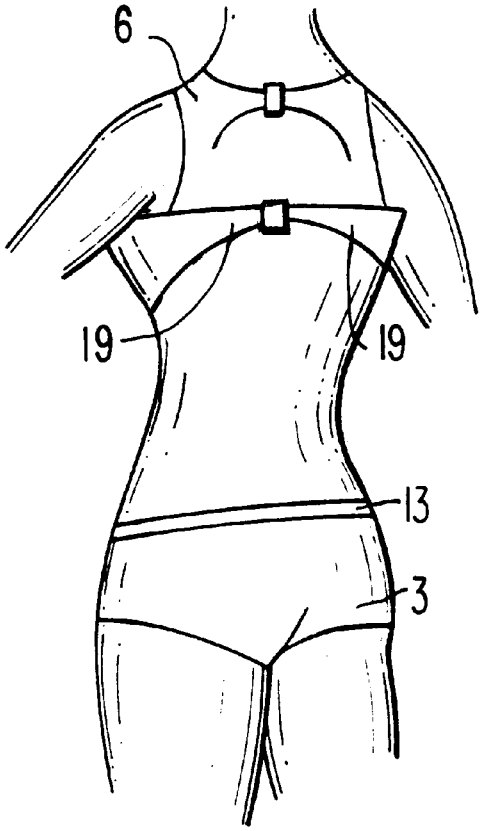
FIG. 14 shows a back view of the swimsuit of the present invention in its state as a bikini-style swimsuit.

As shown best in FIG. 12, another group of fasteners 22 are located between flap 21 and the outer surface of the fabric of swimsuit 1 above bust line portion 7, such that flap 21 is used to hide fasteners from view. Fasteners 22 are adapted to mate with fasteners 15 that are situated along lower edge 10 of midsection 4. When swimsuit 1 is worn as a one-piece swimsuit, as illustrated in FIGS. 1–3, fasteners 22 are covered by flap 21 and are hidden from view. However, when the wearer desires to wear swimsuit 1 as a two-piece swimsuit, as illustrated in FIGS. 13 and 16, fasteners 15,22 cooperate by attaching lower edge 10 of midsection 4 to above bust line portion 7 of swimsuit 1. First, fasteners 15 are detached from fasteners 16. Then, as shown in FIGS. 13–15, midsection 4 is folded upward, either under itself or over bust line portion 7, and fasteners 15 at lower edge 10 of midsection 4 are mated with fasteners 22 under flap 21 above bust line portion 7 so as to attach lower edge 10 of midsection 4 to above bust line portion 7, thereby revealing the wearer's entire midriff 18 and converting swimsuit 1 from a one-piece swimsuit into a two-piece bikini-style swimsuit. Fasteners 16, which are not used when swimsuit 1 is worn as a two-piece swimsuit, are covered by flap 13 and are hidden from view. Fasteners 16 are covered by flap 13 also in order to avoid discomfort to the wearer.

In the first embodiment of fastener orientation discussed previously, as shown in FIG. 12, fasteners 15 at lower edge 10 of midsection 4 are affixed to midsection 4 such that they face outward. Accordingly, in this first embodiment, fasteners 22 above bust line portion 7 that mate with fasteners 15 are affixed to swimsuit 1 such that they also face outward, i.e., they are affixed to the outside surface of the swimsuit fabric above bust line portion 7 such that they face flap 21. Then, when the user desires to mate fasteners 15,22 for the purpose of converting swimsuit 1 into a two-piece bikini-style swimsuit by attaching lower edge 10 of midsection 4 to above bust line portion 7, as illustrated in FIGS. 13 and 15, lower edge 10 of midsection 4 is folded upward and placed between under flap 21 such that fasteners 15 are opposite to fasteners 22, and fasteners 15 are mated with fasteners 22.

In the alternative embodiment of fastener orientation previously discussed (not shown), fasteners 15 at lower edge 10 of midsection 4 are affixed to midsection 4 such that they face inward, and fasteners 22 above bust line portion 7 that mate with fasteners 15 are affixed to the inside surface of flap 21. When the user desires to mate fasteners 15,22 for the purpose of converting swimsuit 1 into a two-piece bikini-style swimsuit by attaching lower edge 10 of midsection 4 to above bust line portion 7, lower edge 10 of midsection 4 is folded upward and placed under flap 21 such that fasteners 15 are opposite to fasteners 22, and fasteners 15 are mated with fasteners 22.

In the above-described embodiments, fasteners 15 could be male and fasteners 17 and 22 could be female, or visa versa. In addition, it should be noted that fasteners 16, fasteners 17 and fasteners 22, which all mate with fasteners 15, should either all be male or all be female, with fasteners 15 being the other.

As shown in the rear views of FIGS. 11 and 14, when midsection 4 is folded upwards either under or over itself such that fasteners 15 at the lower edge 10 of midsection 4 are mated with fasteners 22 under flap 21, the rearmost ends 19 of lower edge 10 of midsection 4 are attached to each other, since neither flap 21 not fasteners 22 extend completely around swimsuit 1. Fasteners 15 at the rearmost ends 19 of lower edge 10 of midsection 4 are arranged so that they can mate to each of fasteners 16 (when swimsuit 1 is in its one-piece mode of FIGS. 2 or 11), fasteners 17 (when swimsuit 1 is in its two-piece tank-top mode of FIG. 5) and fasteners 22 (when swimsuit 1 is in its two-piece bikini-style mode). Thus, fastener 15 at one rearmost end 19 of lower edge 10 of midsection 4 will be male and fastener 15 at the other rearmost end 19 of lower edge 10 of midsection 4 will be female, with the corresponding fasteners 16, 17 and 22 adapted to mate therewith.

Therefore, the wearer can use swimsuit 1 as either a one-piece swimsuit or as a two-piece swimsuit with adjustable coverage of the wearer's stomach or midriff. The swimsuit design of the present invention solves all of the aforementioned design problems and sets forth a completely different swimsuit that is multipurpose in its function while simple in design. The wearer has the ability to easily convert a one-piece swimsuit into a two-piece swimsuit, either as a tank-style two-piece swimsuit or as a bikini-style swimsuit, without detaching, storing or untying pieces of the swimsuit in order to accomplish the conversion. In addition, the styles depicted in these drawings are relatively simple in design and there are a variety of styles, sizes that can be used in producing the present invention and therefore should be considered within the scope of this invention.

Thus, a convertible ladies' swimsuit is provided. One skilled in the art will appreciate that the present invention can be carried out in other ways and practiced by other than the described embodiments, yet not departing from the spirit and essential characteristics depicted herein. The present embodiments therefore should be considered in all respects as illustrative, and the present invention is limited only by the claims that follow.

I claim:

1. A convertible swimsuit comprising:

a top portion having a lower edge and a securing means disposed along at least a portion of the lower edge;

a bottom portion having an upper edge and securing means disposed along at least a portion of the upper edge; and a middle portion continuous with said top portion along said lower edge of said top portion and having a securing means disposed along at least a portion of the lower edge of said midriffportion corresponding to both the securing means disposed along said lower edge of said top portion and the securing means disposed along said upper edge of said bottom portion;

whereby said lower edge of said midriff portion can be secured to said upper edge of said bottom portion to form a one-piece style swimsuit and can be folded upwards and secured to said lower edge of said top portion to form a two-piece style swimsuit.

2. The convertible swimsuit according to claim 1 wherein said securing means comprises snap-type releasable attaching means.

3. The convertible swimsuit according to claim 1 wherein said securing means comprises buttons and button holes.

4. The convertible swimsuit according to claim 1 wherein said securing means comprises hooks and eye-type releasable attaching means.

5. The convertible swimsuit according to claim 1 wherein said securing means comprises resilient hook and loop element-type releasable attaching means.

6. The convertible swimsuit according to claim 1 wherein said securing means disposed along said lower edge of said middle portion are adapted to mate with said securing means disposed along said upper edge of said bottom portion, such that said middle portion can be secured to said bottom portion to form a one-piece style swimsuit.

7. The convertible swimsuit according to claim 1 wherein said securing means disposed along said lower edge of said middle portion are adapted to mate with said securing means disposed along said lower edge of said top portion, such that said middle portion can be folded upwards and said lower edge thereof can be secured to said top portion to form a two-piece style swimsuit.

8. The convertible swimsuit according to claim 7 wherein said lower edge of said middle portion comprises two far rear ends comprising securing means along said lower edges thereof, whereby, when said middle portion is folded upwards, said securing means disposed along said lower edges of said far rear ends of said middle portion are adapted to mate with said securing means disposed along said lower edge of said top portion at a rear region thereof.

9. The convertible swimsuit according to claim 7 wherein said lower edge of said middle comprises two far rear ends comprising securing means along said lower edges thereof, whereby, when said middle portion is folded upwards, said securing means disposed along said lower edges of said far rear ends of said middle portion are adapted to mate with each other at a rear region of said lower edge of said top portion.

10. The convertible swimsuit according to claim 1 further comprising a flap member disposed along at least a portion of said upper edge of said bottom portion and covering said securing means disposed along said upper edge of said bottom portion such that said securing means is disposed between said upper edge of said bottom portion and said bottom portion flap, whereby said securing means is not visible and does not rub against the skin of the wearer.

11. The convertible swimsuit according to claim 1 further comprising a flap member disposed along at least a portion of said lower edge of said top portion and covering said securing means disposed along said lower edge of said top portion such that said securing means is disposed between said lower edge of said top portion and said top portion flap, whereby said securing means is not visible and does not rub against the skin of the wearer.

12. The convertible swimsuit according to claim 1 wherein said top portion securing means is disposed below the bust line of the wearer.

13. The convertible swimsuit according to claim 1 wherein said top portion securing means is disposed above the bust line of the wearer.

14. A swimsuit convertible between a one-piece state and a two piece state comprising.

a top portion having a lower edge;

a bottom portion having an upper edge and securing means disposed along at least a portion of the upper edge; and a middle portion continuous with said top portion along said lower edge of said top portion, having a securing means disposed along at least a portion of the lower edge of said midriff portion and having an attachment means disposed at the back lower edge of said midriff portion;

whereby said lower edge of said midriff portion can be secured to said upper edge of said bottom portion to form a one-piece style swimsuit and can be folded upwards and secured either behind the neck or behind the back of the wearer to form a two-piece style swimsuit.

15. The convertible swimsuit according to claim 14 wherein said securing means comprises one of a group of securing means comprising snap-type releasable attaching means, buttons and button holes, hooks and eye-type releasable attaching means, and resilient hook and loop element-type releasable attaching means.

16. The convertible swimsuit according to claim 14 wherein said securing means disposed along said lower edge of said middle portion are adapted to mate with said securing means disposed along said upper edge of said bottom portion, such that said middle portion can be secured to said bottom portion to form a one-piece style swimsuit.

17. The convertible swimsuit according to claim 14 wherein said lower edge of said middle portion comprises two far rear ends comprising said attachment means, whereby, when said middle portion is folded upwards, said attachment means disposed along said far rear ends of said middle portion are adapted to mate with each other, such that said middle portion can be folded upwards behind the neck of the wearer and said far rear ends thereof can be secured behind the neck of the wearer to form a two-piece style swimsuit.

18. The convertible swimsuit according to claim 14 wherein said lower edge of said middle portion comprises two far rear ends comprising said attachment means, whereby, when said middle portion is folded upwards, said attachment means disposed along said far rear ends of said middle portion are adapted to mate with each other, such that said middle portion can be folded upwards and said far rear ends thereof can be secured behind the back of the wearer to form a two-piece style swimsuit.

19. A convertible swimsuit comprising:

a top portion having a front and a securing means disposed across at least a portion of the front;

a bottom portion having an upper edge and securing means disposed along at least a portion of the upper edge; and a middle portion continuous with said top portion along said lower edge of said top portion, having a securing means disposed along at least a portion of the lower edge of said midriff portion;

whereby said lower edge of said midriff portion can be secured to said upper edge of said bottom portion to form a one-piece style swimsuit and can be folded upwards and secured to said top portion to form a two-piece style swimsuit.

20. The convertible swimsuit according to claim 19 wherein said securing means comprises one of a group of securing means comprising snap-type releasable attaching means, buttons and button holes, hooks and eye-type releasable attaching means, and resilient hook and loop element-type releasable attaching means.

21. The convertible swimsuit according to claim 19 wherein said securing means disposed along said lower edge of said middle portion are adapted to mate with said securing means disposed along said upper edge of said bottom portion, such that said middle portion can be secured to said bottom portion to form a one-piece style swimsuit.

22. The convertible swimsuit according to claim 19 wherein said securing means disposed along said lower edge of said middle portion are adapted to mate with said securing means disposed across said top portion, such that said middle portion can be folded upwards and said lower edge thereof can be secured to said top portion to form a two-piece style swimsuit.

23. The convertible swimsuit according to claim 22 wherein said top portion securing means is disposed below the bust line of the wearer.

24. The convertible swimsuit according to claim 22 wherein said top portion securing means is disposed above the bust line of the wearer.

25. The convertible swimsuit according to claim 19 wherein said lower edge of said middle portion comprises two far rear ends comprising attachment means, whereby, when said middle portion is folded upwards, said attachment means disposed along said far rear ends of said middle portion are adapted to mate with each other, such that said middle portion can be folded upwards and said far rear ends thereof can be secured behind the back of the wearer to form a two-piece style swimsuit.

26. A swimsuit comprising:

a top portion having upper and lower regions, each having a front, said top region having a securing means disposed across at least a portion of the front thereof, and said lower region hiving a lower edge and a securing means disposed along at least a portion of the lower edge;

a bottom portion having m upper edge and securing means disposed along at least a portion of the upper edge; and whereby said lower edge of said lower region of said top portion can be secured to said upper edge of said bottom portion to form a one-piece style swimsuit and can be folded upwards and secured to said top portion to form a two-piece style swimsuit.

27. The convertible swimsuit according to claim 26 wherein said securing means disposed along said lower edge of said top portion lower region are adapted to mate with said securing means disposed along said upper edge of said bottom portion.

28. The convertible swimsuit according to claim 26 wherein said securing means disposed along said lower edge of said top portion lower region are adapted to mate with said securing means disposed across said front of said top portion.

29. The convertible swimsuit according to claim 26 wherein said top portion securing means is disposed below the bust line of the wearer.

30. The convertible swimsuit according to claim 26 wherein said top portion securing means is disposed above the bust line of the wearer.

31. The convertible swimsuit according to claim 26 wherein said lower edge of said top portion lower region comprises two far rear ends comprising attachment means adapted to mate with each other.

* * * * *